United States Patent [19]

Andres

[11] Patent Number: 4,564,060

[45] Date of Patent: Jan. 14, 1986

[54] RADIATOR INCLUDING A COVER THEREFOR

[75] Inventor: Rudolf Andres, Sindelfingen, Fed. Rep. of Germany

[73] Assignee: Daimler-Benz Aktiengesellschaft, Stuttgart, Fed. Rep. of Germany

[21] Appl. No.: 661,209

[22] Filed: Oct. 15, 1984

[30] Foreign Application Priority Data

Oct. 18, 1983 [DE] Fed. Rep. of Germany ..... 3337780

[51] Int. Cl.[4] ..... F01P 7/10

[52] U.S. Cl. ..... 165/98; 123/41.04

[58] Field of Search ..... 165/96 HV, 98, 99; 123/41.04, 41.05, 41.06

[56] References Cited

U.S. PATENT DOCUMENTS 2,133,514 10/1938 Holmes ..... 165/98 X 2,246,823 6/1941 Vollberg et al. ..... 165/98 X

FOREIGN PATENT DOCUMENTS 228446 7/1963 Austria ..... 165/98

679935 7/1939 Fed. Rep. of Germany ..... 165/98

*Primary Examiner*—Albert W. Davis, Jr.

*Assistant Examiner*—Peggy A. Neils

*Attorney, Agent, or Firm*—Barnes & Thornburg

[57] ABSTRACT

In radiators, especially in automotive vehicles, covers for throttling the cooling air disposed in front of such radiators are exposed to damage, dirt, we well as the danger of icing, so that their function can be impaired. In order to overcome these disadvantages, it is disclosed to subdivide the radiator into two groups disposed in series in the flow direction of the cooling air, with an interspace therebetween wherein the cover is guided.

3 Claims, 1 Drawing Figure

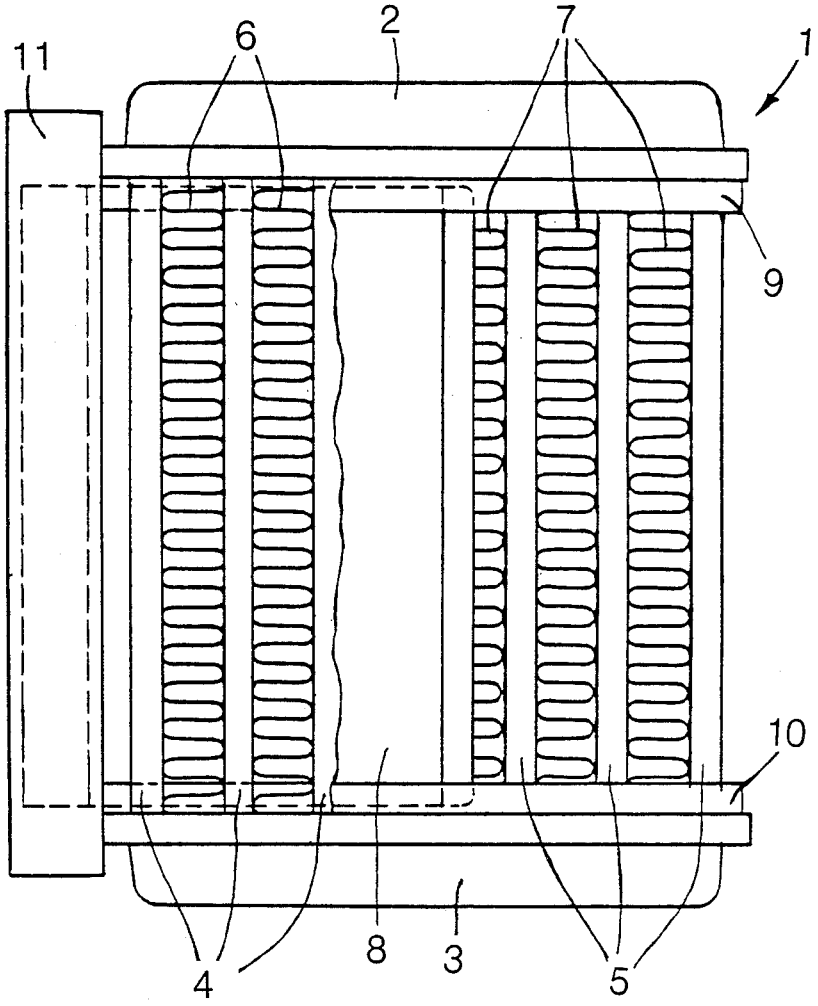
11
6
2
7
1
9
10
4
8
3
5

RADIATOR INCLUDING A COVER THEREFOR

BACKGROUND AND SUMMARY OF THE INVENTION

The invention relates to a radiator for an automotive vehicle of the type having tubes traversed by coolig fluid and cooling air flowing perpendicular to the extension of the tubes, with a movable cover extending transversely to the cooling air flow.

Such a radiator is disclosed in German Pat. No. 854,902. In the radiator of the German patent, the cover is located in front of the radiator as seen in the flow direction of the air. There is the danger in this arrangement that the cover will ice over at corresponding cold outside temperatures and will not thaw even when the radiator is heated up, so that the operability of the cover and consequently the air flow through the radiator are impaired. External components projecting forwardly from the radiator can have a similar effect. Also, the cover is exposed to dirt and mechanical damages to a considerable extent.

The invention is based on the object of ensuring the functioning capacity of the cover even under adverse circumstances, and also protecting the cover from dirt and damage.

This object has been attained according to the invention by subdividing the radiator into two groups of tubes and cooling fins disposed in series one behind the other in the flow direction of the cooling air, and by disposing the cover in an interspace between these two groups.

In the radiator constructed according to this invention, the cover is located where it is better protected from dirt, water, and snow. Any ice that may form will thaw within the radiator with certainty while the radiator is heating up. The operability of the cover thus remains preserved. Moreover, in the arrangement of this invention, the cover requires less installation space since it needs less of a spacing within the radiator with respect to the parts of the radiator than in case of being mounted in front of the radiator with respect to attachments, for example of an automotive vehicle.

Further objects, features, and advantages of the present invention will become more apparent from the following description when taken with the accompanying drawings which show, for purposes of illustration only, embodiments constructed in accordance with the present invention.

BRIEF DESCRIPTION OF THE DRAWINGS

The single drawing figure schematically depicts a radiator and cover arrangement constructed in accordance with a preferred embodiment of the present invention.

DETAILED DESCRIPTION OF THE DRAWINGS

A radiator 1 is composed of an upper water tank 2 and a lower water tank 3 joined by vertical tubes 4, 5 traversed by cooling fluid. Fins 6, 7 are installed between the tubes 4, 5. The radiator 1 has cooling air flowing therethrough perpendicularly to the plane of the drawing.

The tubes 4 and the fins 6, on the one hand, as well as the tubes 5 and the fins 7, on the other hand, are combined into respectively one group, disposed one behind the other in the flow direction of the cooling air and forming between them an interspace. For illustration purposes the group of tubes 4 and fins 6 at the front of the radiator are only dipicted in the drawings at the left-hand side, it being understood that they extend across the width of the radiator. Likewise, the group of tubes and fins 7 is illustrated only on the right-hand side of the drawing even though they extend across the width of the radiator. Within this interspace, a cover 8 is displaceably guided in horizontal guide rails 9, 10 attached to the radiator tanks 2, 3. For this purpose, a roll-up mechanism 11 is laterally mounted to the radiator 1; the cover 8 can be rolled up on this mechanism and unrolled therefrom. The drawing shows the cover 8 in a condition wherein it is approximately half unrolled so that the radiator 1 is partially covered, and the cooling air stream is throttled. The roll-up mechanism 11 can be operated in a conventional manner, not shown herein, automatically, for example in dependence on the temperature of the cooling fluid, or manually.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Radiator arrangement comprising:

a first group of cooling fluid tubes and cooling fins disposed for the flow of cooling air transversely thereto, a second group of cooling fluid tubes and cooling fins disposed for the flow of cooling air transversely thereto, said first and second groups being disposed in series one behind the other in the direction of flow of cooling air, and movable cover means interposed in an interspace between said first and second groups, such that the functioning capacity of the cover under adverse circumstances is improved.

2. An arrangement according to claim 1, wherein said first and second groups are disposed in spaced apart substantially parallel plans, said cover extending in a third parallel plane between the groups.

3. An arrangement according to claim 2, wherein a cover roll up means is provided at one lateral side of the first and second groups to accommodate rolling up of the cover.

* * * * *

UNITED STATES PATENT AND TRADEMARK OFFICE

CERTIFICATE OF CORRECTION

PATENT NO. : 4,564,060

DATED : January 14, 1986

INVENTOR(S) : Rudolf Andres

It is certified that error appears in the above-identified patent and that said Letters Patent is hereby corrected as shown below:

Column 1, line 8, change "coolig" to --cooling--;

Column 2, line 16, change "dipicted" to --depicted--;

Column 2, line 56, change "plans" to --planes--.

Signed and Sealed this

*Twenty-ninth* Day of *April 1986*

[SEAL]

*Attest:*

DONALD J. QUIGG

*Attesting Officer*

*Commissioner of Patents and Trademarks*